US009402460B2

(12) United States Patent
Hickey

(10) Patent No.: US 9,402,460 B2
(45) Date of Patent: Aug. 2, 2016

(54) HAIR BRUSH

(71) Applicant: Paris Presents Incorporated, Chicago, IL (US)

(72) Inventor: Jerry Hickey, Chicago, IL (US)

(73) Assignee: PARIS PRESENTS INCORPORATED, Gurnee, IL (US)

( * ) Notice: Subject to any disclaimer, the term of this patent is extended or adjusted under 35 U.S.C. 154(b) by 180 days.

(21) Appl. No.: 14/290,663

(22) Filed: May 29, 2014

(65) Prior Publication Data

US 2015/0342334 A1 Dec. 3, 2015

(51) Int. Cl.
*A46B 9/02* (2006.01)

(52) U.S. Cl.
CPC ..... *A46B 9/023* (2013.01); *A46B 2200/104* (2013.01)

(58) Field of Classification Search
CPC ..... A46B 9/023; A46B 2200/104
USPC ..... 15/159.1, 160, 186, 187; 132/120; D4/130, 132–134, 136
See application file for complete search history.

(56) References Cited

U.S. PATENT DOCUMENTS

| | | | | | |
|---|---|---|---|---|---|
| 1,375,755 | A | * | 4/1921 | Hastings | A46B 5/00 300/21 |
| 1,957,363 | A | * | 5/1934 | Snell | A46B 3/16 15/186 |
| 3,140,499 | A | * | 7/1964 | Du Bois | A46B 5/00 15/160 |
| D292,850 | S | * | 11/1987 | Glasberg | D4/128 |
| 5,327,611 | A | * | 7/1994 | Balster | A46B 5/00 15/160 |
| D366,567 | S | * | 1/1996 | Gertsma | D4/133 |
| 6,006,395 | A | * | 12/1999 | Tiramani | A46B 5/0025 15/176.1 |
| D423,227 | S | * | 4/2000 | Amante | D4/133 |
| D423,792 | S | * | 5/2000 | Amante | D4/133 |
| 7,010,827 | B2 | * | 3/2006 | Kim | A46B 5/0029 132/120 |
| 2011/0088188 | A1 | * | 4/2011 | Ghodsi | A46B 15/0055 15/143.1 |
| 2011/0094528 | A1 | * | 4/2011 | Leung | A46B 9/023 132/120 |
| 2011/0239390 | A1 | * | 10/2011 | Park | A45D 20/12 15/160 |

FOREIGN PATENT DOCUMENTS

| | | | |
|---|---|---|---|
| BE | 1007329 | * | 5/1995 |
| EP | 141532 | * | 5/1985 |
| EP | 882414 | * | 12/1998 |
| FR | 576009 | * | 8/1924 |
| FR | 2307493 | * | 11/1976 |
| FR | 2473287 | * | 7/1981 |
| GB | 2054368 | * | 2/1981 |
| JP | 2004-8669 | * | 1/2004 |
| JP | 2009-189560 | * | 8/2009 |

* cited by examiner

*Primary Examiner* — Mark Spisich
(74) *Attorney, Agent, or Firm* — Quarles & Brady LLP

(57) ABSTRACT

Hair brushes are disclosed that include a brush head having opposing front and back sides with a hollow portion therebetween. The back side includes a plurality of longitudinal apertures that extend between first and second ends of the brush head, at least one of the longitudinal apertures having a length L. The front side includes first and second sets of apertures separated by a medial portion. At least one of the apertures of the first and second sets of apertures has a length dimension of at least about 0.3 L to about 0.6 L.

20 Claims, 11 Drawing Sheets

HAIR BRUSH

CROSS REFERENCE TO RELATED APPLICATIONS

Not applicable

REFERENCE REGARDING FEDERALLY SPONSORED RESEARCH OR DEVELOPMENT

Not applicable

SEQUENCE LISTING

Not applicable

BACKGROUND OF THE INVENTION

1. Field of the Background

The present invention relates generally to a hair brush.

2. Description of the Background

Various hair brushes are known that generally include a handle, a brush head, and bristles for brushing hair. Oftentimes such hair brushes are used to brush wet hair to facilitate the drying of the hair. When so used, a user may also use a hair dryer to apply heat and increased air flow to speed the rate of evaporation of water from the hair. However, many prior art brushes interfere with the application of heat and air flow from the hair dryer, thereby prolonging the drying process.

One answer to the interference caused by these brushes is to add apertures to the brush head that allow air to flow through the brush head. For example, one hair brush allows air blown from a hair dryer to the rear face side of the hair brush to be smoothly guided to through-holes in the hair brush to send the air to the front face side. The hair brush includes divergent projections formed on a rear face of a base section, and through-holes are respectively formed in depressions located between the projections. A cushion member of a brush section is fixed to the front face side of the base section of the hair brush, and bristles are embedded in the cushion member. Air blown from the hair dryer to the rear face side of the hair brush is guided by the projections to the depressions located between the projections and enters the through-holes. The air passed through the through-holes passes through the holes in the cushion member and is sent to the front face side of the hair brush.

In another example, a hair brush includes bristles extending from openings extending through a cushion on the base of the hair brush. The openings allow a flow of air from a hand-held hair dryer or blower to reach the hair and scalp during brushing. The brush has a handle, a base connected to the handle, and vents running through the base. Bristles are mounted on a long, narrow, substantially rectangular track. The track is affixed to the base so that the bristles extend from the openings. The openings are wider than the tracks and bristles to allow a flow of air to pass through.

However, such prior art hair brushes are poorly designed to achieve maximal drying effect. For example, some hair brushes incorporating through-holes include dozens of small through-holes to allow air to pass through the brush head. Further, other hair brushes include only a few holes located on the back of the brush head, but a multitude of small holes on the face of the brush head between the bristles. These designs choke the air flow from the hair dryer through the brush head. Other examples of hair brushes include elongate apertures on opposite sides of the brush head face requiring an awkward angle for application of the air stream from a hair dryer.

There is a need, therefore, for hair brushes that maximize drying ability when used in concert with hair dryers.

SUMMARY OF THE INVENTION

According to one aspect, a hair brush includes a brush head including opposing front and back sides having a hollow portion therebetween. The back side includes a plurality of longitudinal apertures that extend between first and second ends of the brush head, at least one of the longitudinal apertures having a length L. The front side includes first and second sets of apertures separated by a medial portion. At least one of the apertures of the first and second sets of apertures has a length dimension of at least about 0.3 L to about 0.6 L.

According to another aspect, a hair brush includes a head including a front side having a face, a back side, and first and second ends, wherein an internal volume extends between the front and back sides and the first and second ends. The hair brush further includes a plurality of bristles extending generally perpendicularly from the face, each bristle having a base associated with the face and a shaft extending from the base to a bristle tip. A bristle volume extends from the base to the bristle tip and between the plurality of bristles. A ratio of the internal volume to the bristle volume is about 1:1.

According to a further aspect, a hair brush includes a handle, a head that extends from the handle, the head including a front side having a face, a back side, and an internal volume extending between the front side and the back side, a plurality of inlets disposed on the back side defining an inlet area, and a plurality of outlets disposed in the face defining an outlet area. A ratio of the inlet area to the outlet area is at least about 1:1.

BRIEF DESCRIPTION OF THE DRAWINGS

Other aspects and advantages of the present invention will become apparent upon reading the following detailed description and upon reference to the drawings in which.

DETAILED DESCRIPTION OF THE INVENTION

Figure 1:
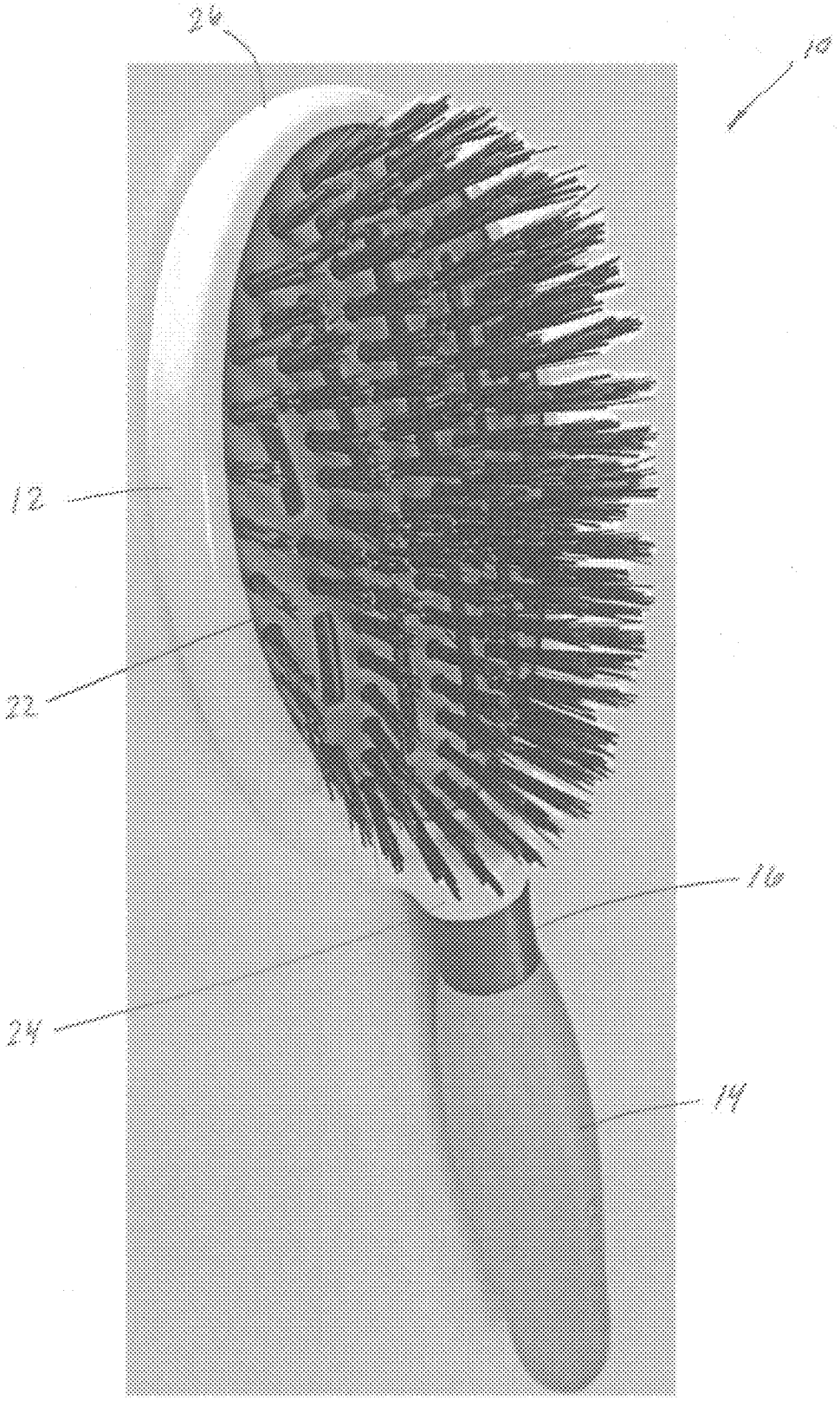
FIG. 1 is a perspective view of a hair brush according to one embodiment.
Figure 2:
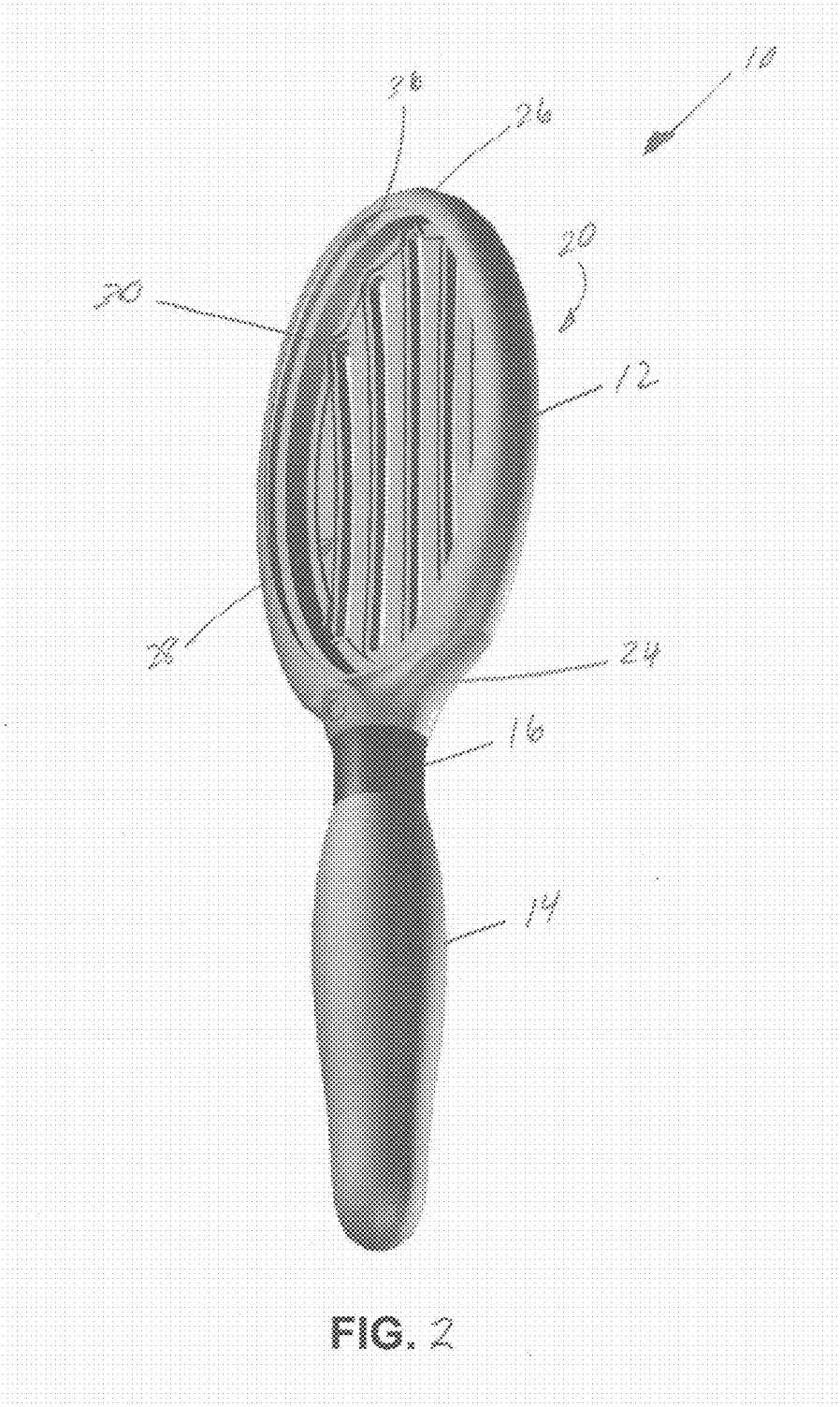
FIG. 2 is an isometric view of a partial front, bottom, and left side of the hair brush of FIG. 1.
Figure 3:
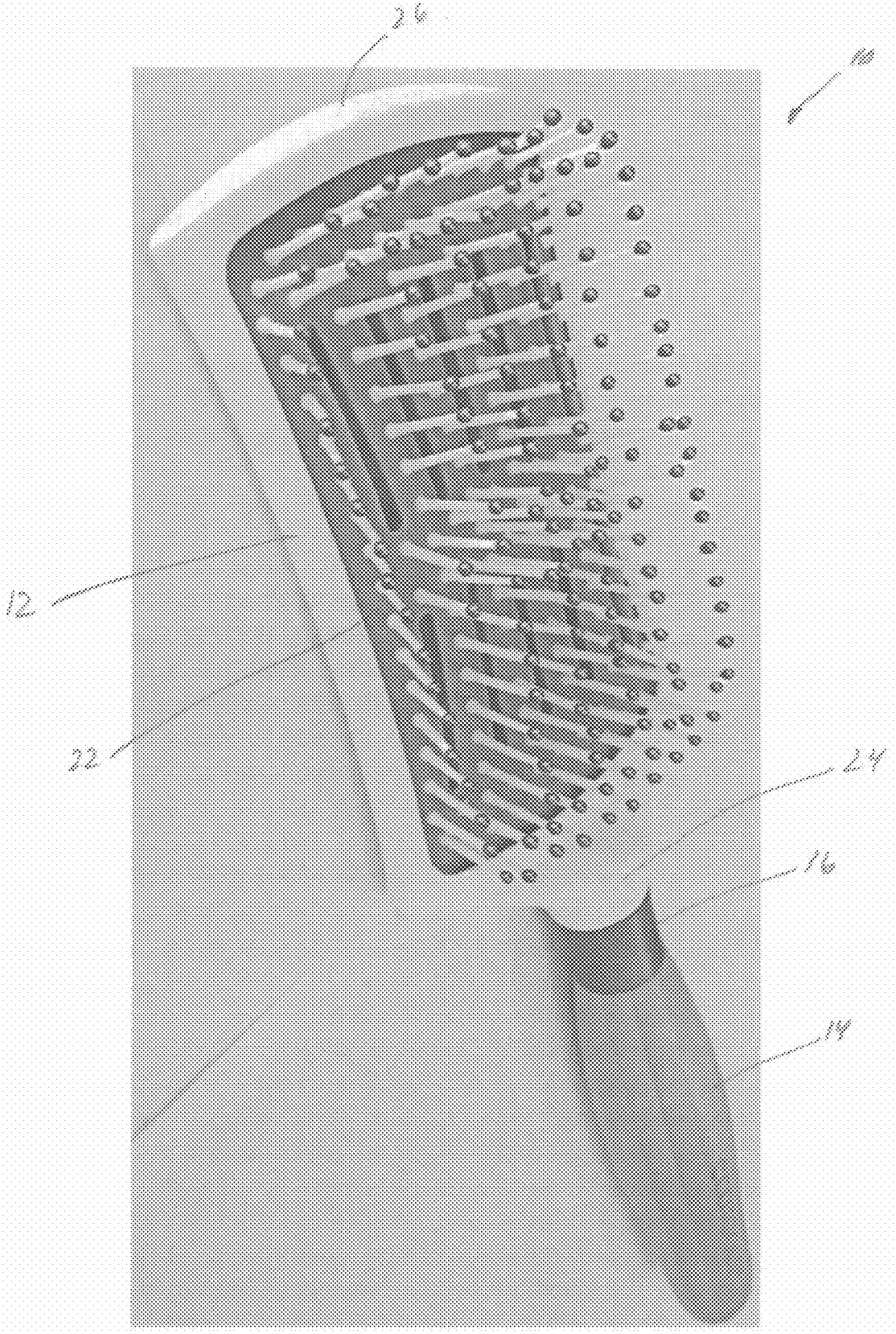
FIG. 3 is a perspective view of a hair brush according to another embodiment.
Figure 4:
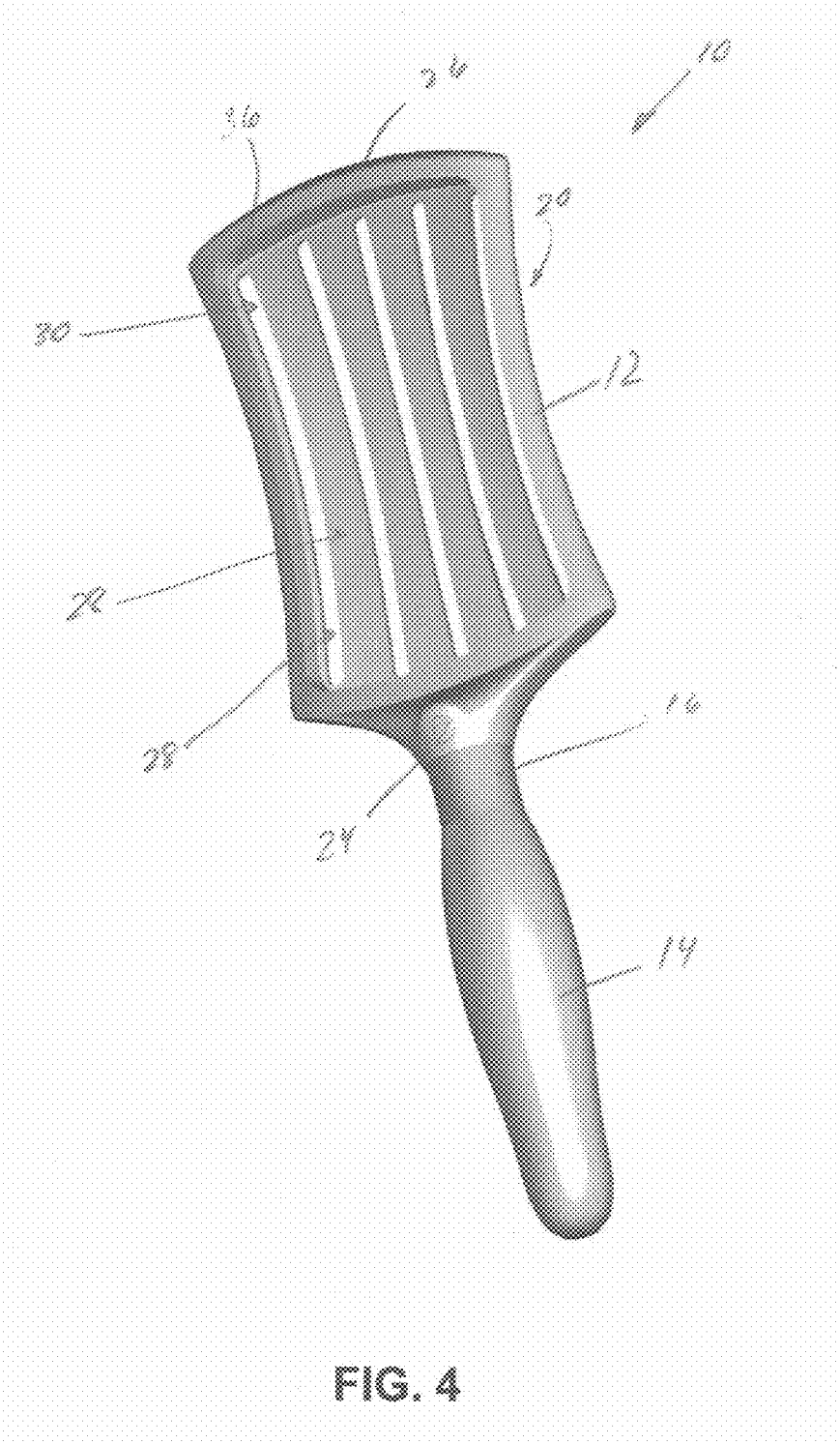
FIG. 4 is an isometric view of a partial front, bottom, and left side of the hair brush of FIG. 3.
Figure 5:
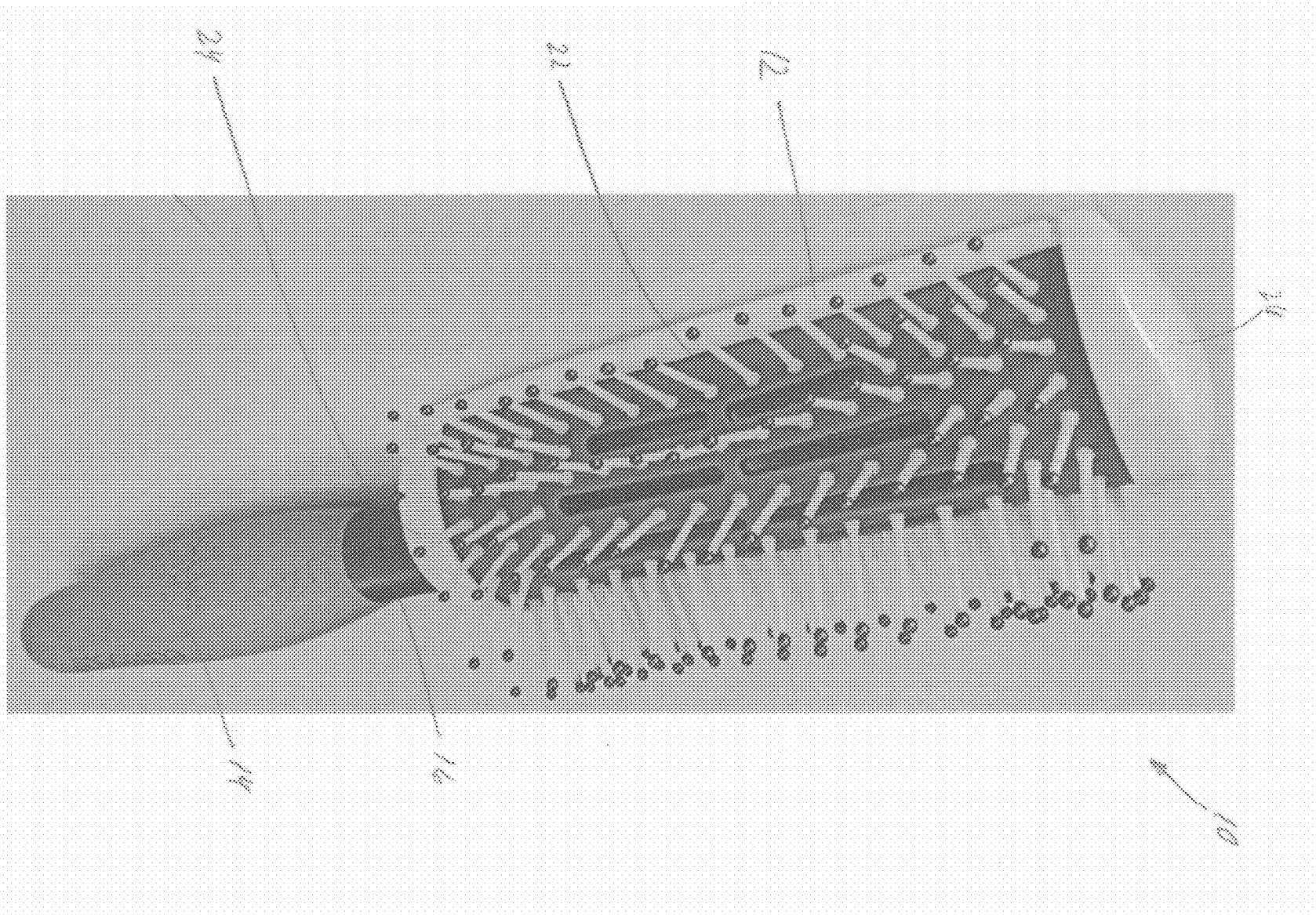
FIG. 5 is a perspective view of a hair brush according to a further embodiment.

As depicted in FIGS. 1 to 12, a hair brush 10 (e.g., an oval, paddle, or agility or half-round paddle, or other style) of the present disclosure generally includes a head 12 and a handle 14. The head 12 and handle 14 may be joined by any means, including frictional interference, adhesives, fasteners, or other means. In one embodiment, a ferrule 16 may be used to join the handle 14 and the head 12. While not wishing to be bound by theory, it is believed that the ferrule 16 may facilitate joining of dissimilar materials such as a wooden or other natural material handle 14 and a plastic head 12. The ferrule 16 may be made of any suitable material including a natural material, a metal, plastic, and the like. In another embodiment (seen in FIG. 6), a handle mount 14*a* may extend from the brush head 12 to provide a base for a sturdy connection between the handle 14 and the head. The handle mount 14*a* may be formed integrally with the brush head 12 or may be separately formed and attached to the head. The handle mount 14*a* may further include lock and key features 18 such as a ridge, groove, tooth, pattern, and combinations thereof, or other features that rotationally orient a handle 14 to be connected to the handle mount in a preferred orientation.

Figure 6:
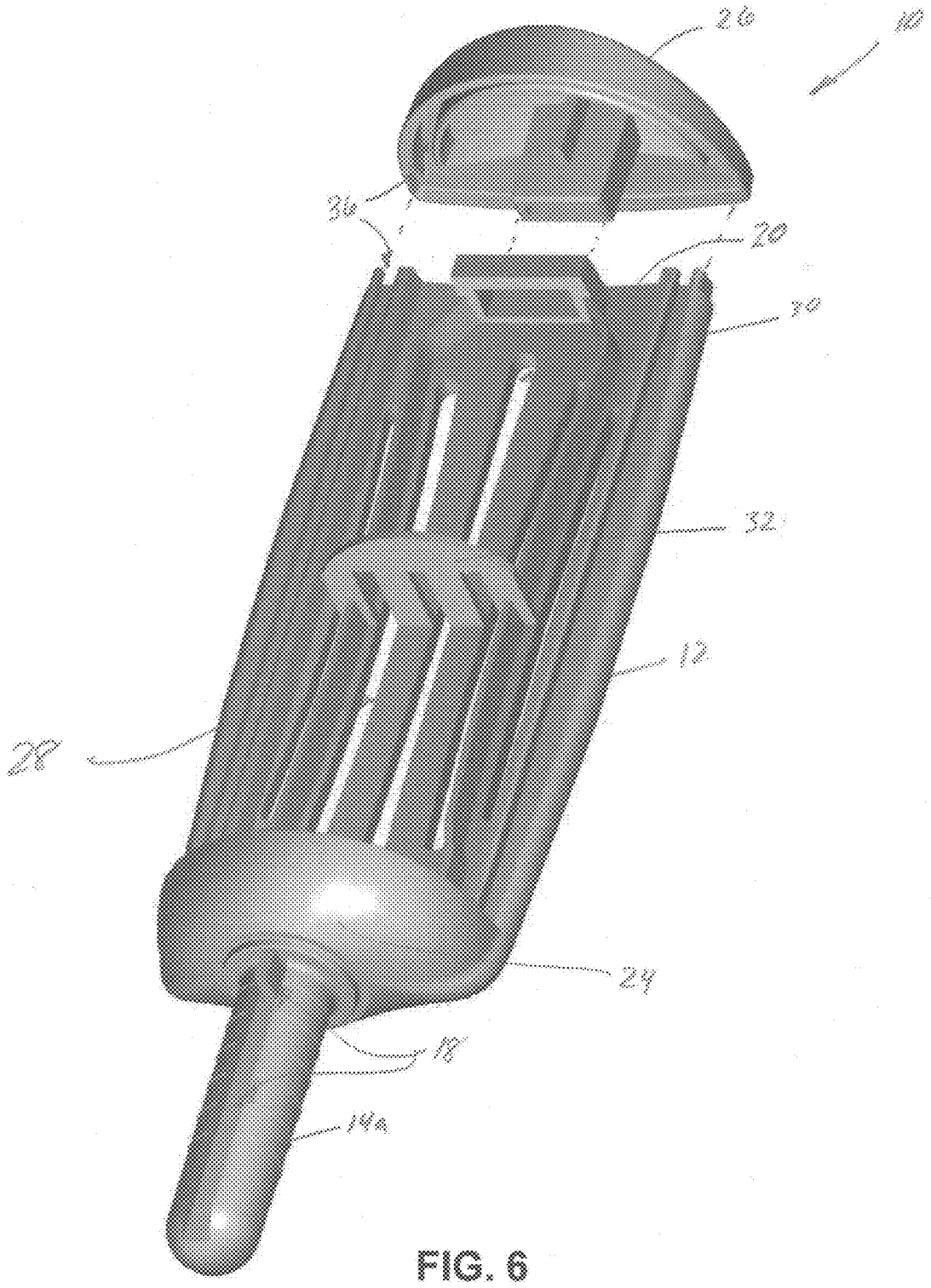
FIG. 6 is an exploded partial isometric view of a front, bottom, and left side of the hair brush of FIG. 5.

The brush head 12 includes a back side 20, a flexible front side 22, a first end 24, and a second end 26, which together bound an interior, hollow portion 28 or internal volume (an uninterrupted void space within the brush head 12). The back side 20 may be a single, monolithic structure or may be modular, as seen in FIG. 6. The back side 20 includes one or more longitudinal apertures 30. In one embodiment, the longitudinal apertures 30 on the back side 20 of the brush head 14 may have a length L. The length L may be measured by following the contour of an aperture (see e.g., L' of FIG. 8), which measures the absolute length of the opening of the smallest restriction area (aperture area) or by measuring the length of the aperture along a longitudinal axis y irrespective of the curve (along either x or z axes) of the aperture (see e.g., L" of FIG. 8). The length L may be about 10 centimeters (±10%), or about 9 centimeters, or about 8 centimeters, or about 6 centimeters, or about 4 centimeters, or a length L ranging from about 4 to about 6 centimeters, or about 6 to about 8 centimeters, or about 8 to about 10 centimeters, or about 4 to about 12 centimeters.

Figure 7:
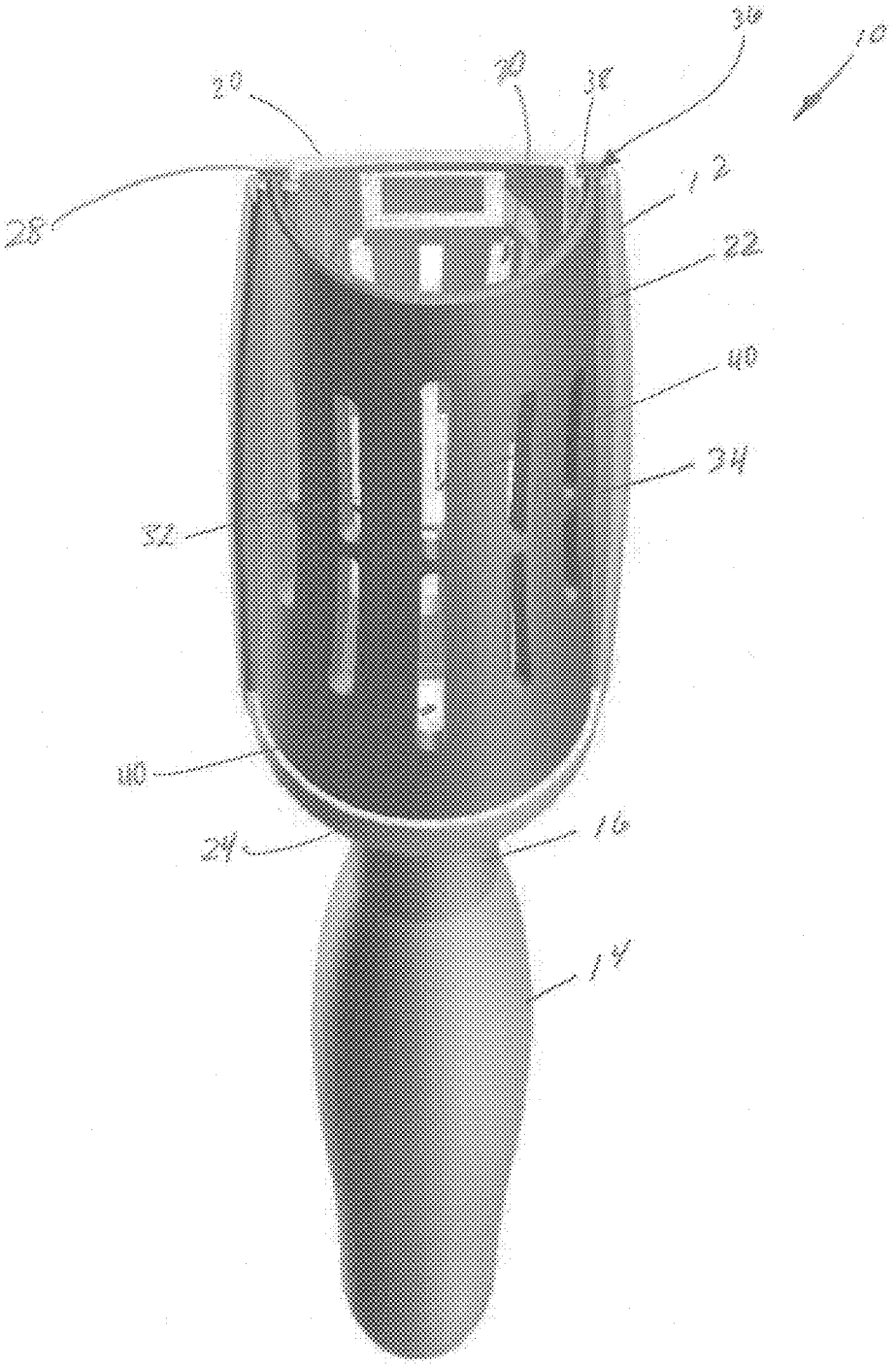
FIG. 7 is a front top elevational view of the hair brush of FIG. 5 partially assembled with a front side or insert.
Figure 8:
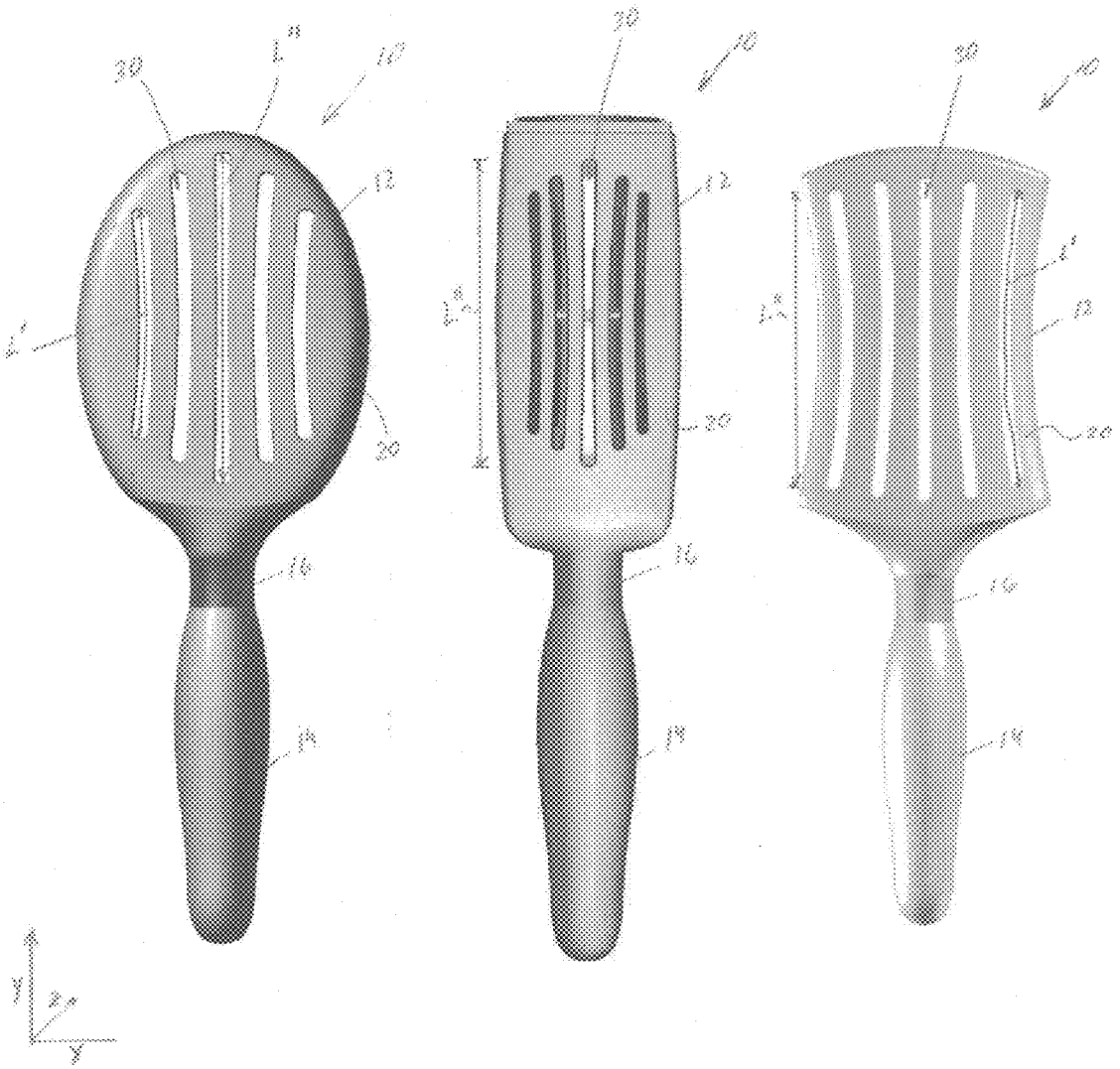
FIG. 8 is a rear elevational view of the hair brushes of FIGS. 2, 4, and 7.

In one embodiment shown in FIGS. 6 and 7, the back side 20 may further include a medial projection 32 that is aligned beneath a medial portion 34 of the front side 22. The medial projection 32 provides support to the front side 22 when in use.

Figure 9:
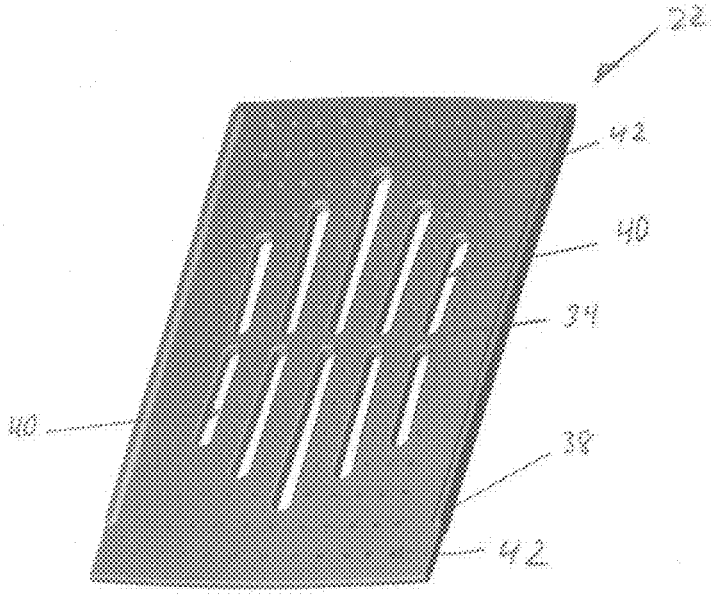
FIG. 9 is an isometric view of a front, bottom, and left side of a front side or insert for a hair brush according to one embodiment.
Figure 10:
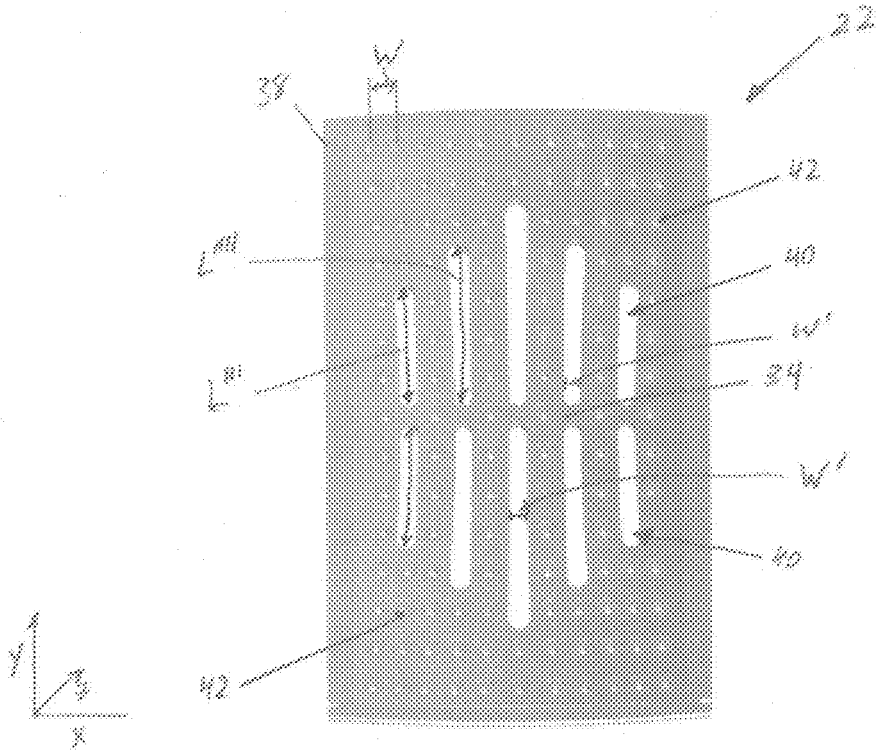
FIG. 10 is a front elevational view of the insert of FIG. 9.

FIGS. 9 and 10 are illustrative of the front side 22 or insert, which may be shaped to fit any shaped brush head 12 shown herein or otherwise. The front side 22 may be formed as a wholly or partially flexible insert that may be attached to the back side 20 by means of a friction fit within an internal groove 36 (as seen in FIGS. 2, 4, 6, and 7) or by other means, such as an adhesive. In one embodiment, the front side 22 may include a lip 38 to insert into the internal groove 36 to lock the front side to the back side 20. The front side 22 may further include first and second sets of apertures 40 separated by the medial portion 34 that adds structural integrity to the front side. The first and second sets of apertures 40 may have a length dimension measured similarly as described with respect to the apertures 30 in the back side 20. For example, as seen in FIG. 10, the length may be measured by following the contour of an aperture 40 (see e.g., L'" of FIG. 10), which measures the absolute length of the opening of smallest restriction area (aperture area) or by measuring the opening of the aperture along a longitudinal axis y irrespective of the curve (along either x or z axes) of the aperture (see e.g., L"" of FIG. 10). The length of the apertures 40 may be expressed as a multiple of the length L of apertures 30 and may be about 0.8 L, or about 0.6 L, or about 0.5 L, or about 0.4 L, or about 0.3 L, or ranging from about 0.3 to about 0.6 L.

Figure 11:
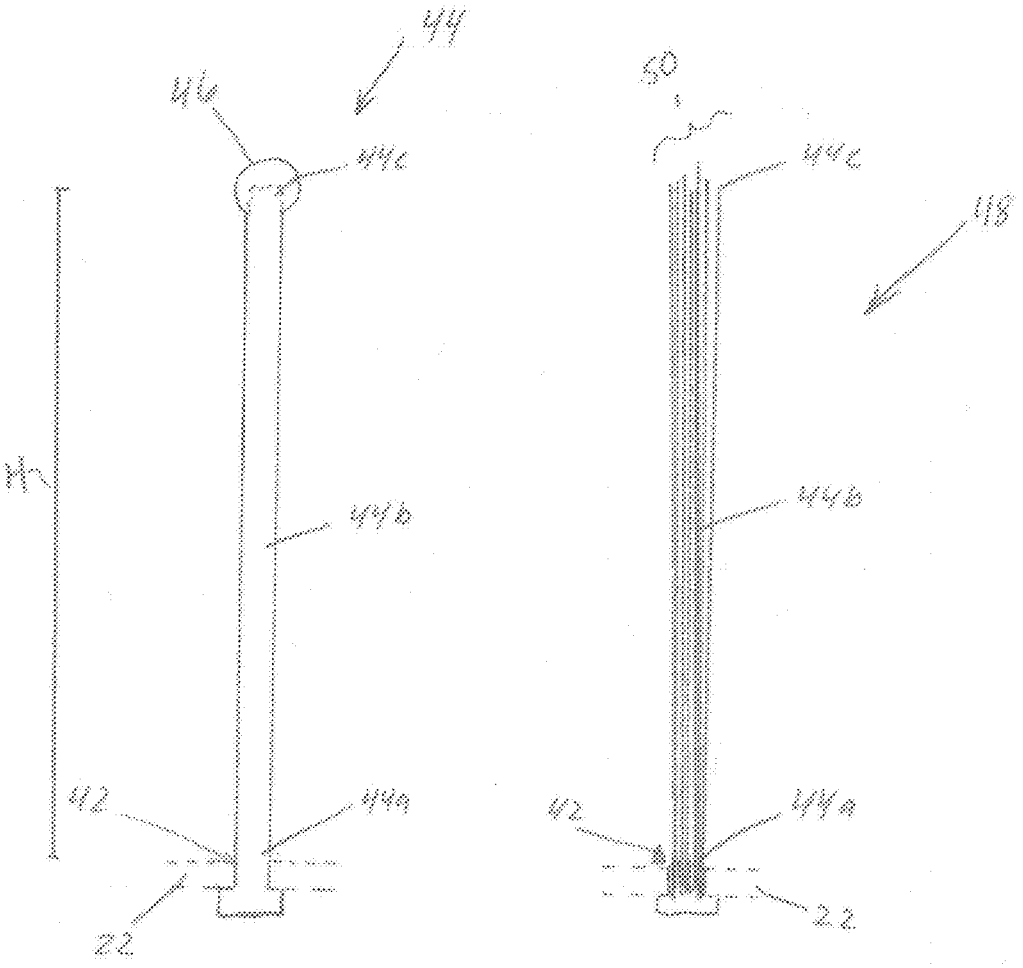
FIG. 11 is a front elevational view of a schematic of two types of bristles.
Figure 12:
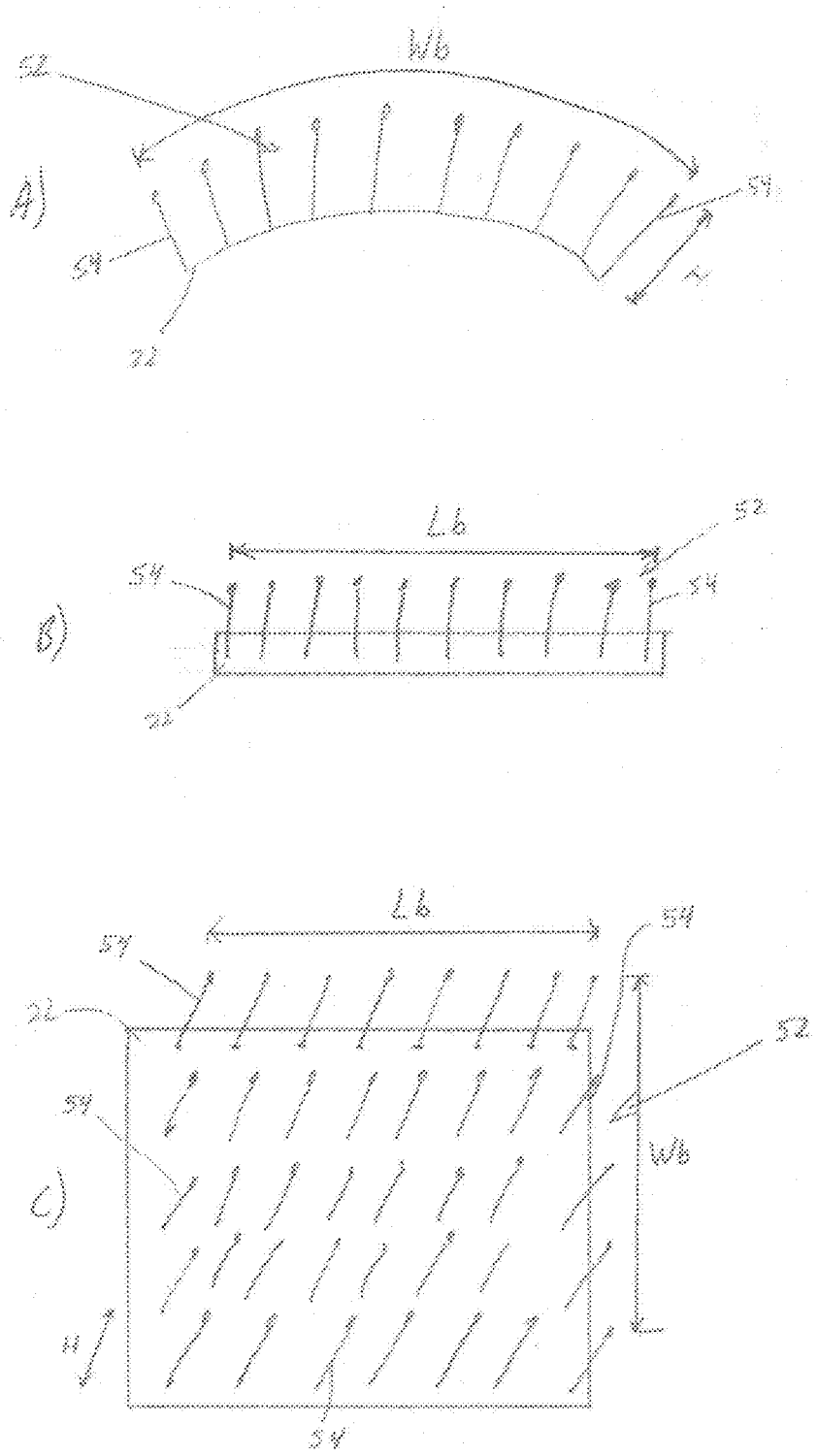
FIG. 12A is a top elevational view of a schematic of an insert with bristles according to one embodiment.
FIG. 12B is a side elevational view of FIG. 12A.
FIG. 12C is a perspective view of an insert with bristles according to another embodiment.

The front side 22 further includes bristle apertures 42 sized to accept a bristle 44 therethrough. The front side 22 may further include a plurality of bristles 44. The bristles 44 may be single post-like bristles including a base 44*a*, a shaft 44*b* extending from the base, and a bristle tip 44*c*, as seen in FIG. 11. In one embodiment, post-like bristles 44 may be capped with a bristle cap 46. Bristle caps 46 may be spherical or a have another shape, such as ovoid, rectilinear, cylindrical, and the like. In another embodiment, the bristles 44 may be in the form of a bristle cluster 48 that includes a plurality of fine bristles 50 clustered or bunched together and joined together at a common base 44*a*. A bristle cluster 48 may include a number of fine bristles 50 ranging from about 3 to about 10, or about 5 to about 20, or about 10 to about 30 fine bristles, or may include about 10, or about 15, or about 20 fine bristles. The bristles 44 and bristle clusters 48 may be attached to the front side 22 of the brush head 12 by passing through the bristle apertures 42 and secured thereto by heat welding, adhering with an adhesive, frictional interference, snap fit, or other mechanical or chemical means known in the art.

The bristles 44 and bristle clusters 48 may be disposed in longitudinal rows or in any other pattern and extend substantially perpendicularly from one or more planes defined by the circumference of the bristle apertures 42 on the face of the front side 22 or insert. In one embodiment, the bristles 44 are disposed in rows spaced apart by a width W measured along the x axis on center from one row of bristle apertures to an adjacent row of bristle apertures, as seen in FIG. 10. The width W may be about 0.3 cm, or about 0.4 cm, or about 0.5 cm, or about 0.7 cm, or about 1 cm. In one embodiment, the longitudinal apertures 30 and apertures 40 of the front side 22 may each individually have a width dimension W' measured along the x axis of the opening of smallest restriction area (aperture area) that ranges from about 0.3 W to about 1.5 W, or about 0.5 to about 1.2 W, or about 0.8 to about 1 W, or a width dimension of about 0.4 W, or about 0.6 W, or about 0.8 W, or about 1 W.

In one embodiment, the bristles 44 define a bristle volume 52. The bristle volume 52 has a thickness equal to the bristle height H (e.g., distance between the base 44*a* at the top surface of the front side 22 and the tip 44*c*) and length Lb and width Wb dimensions defined by an area outlined by peripheral bristles 54 on the front side 22. In one embodiment, the bristle volume 52 ranges from about 80 to about 200 cubic centimeters ($cm^3$), or about 100 to about 180 $cm^3$, or about 120 to about 160 $cm^3$. In another embodiment, a ratio of the internal volume 28 compared to the bristle volume 52 is about 4:1, or about 2:1, or about 1:1, or about 1:2, or about 1:4, or about 1:8, or ranges from about 2:1 to about 1:2.

Brushes 10 of the present disclosure are designed to provide improved drying ability. Optimizing the ratio of the internal volume 28 to the bristle volume 52 is one method that may contribute to this goal. Having increased air volume within the brush head 12, as well as within the bristle volume 52 provides a larger air mass that can absorb moisture. While not wishing to be bound by theory, it is believed that with each stroke of the brush 10 moist air is introduced into the bristle volume 52 and subsequently into the interior volume 28. Therefore, the larger the interior volume 28, the greater the capacity for transferring moisture from the bristle volume 52 and removing moisture from wet hair, which translates into improved drying ability.

A further embodiment to improve drying ability is to employ a convex front side 22 with bristles 44 of the same length, such as is seen in FIG. 1. In this embodiment, the centrally disposed bristles will contact the scalp of a user and the peripherally disposed bristles will be spaced from the scalp to provide a gap for air exhaust.

Another method to improve drying ability is to improve directional air flow through the brush head 12 and bristle volume 52 when the brush 10 is used in conjunction with a hair dryer. For example, misalignment of the apertures 40 on the front side 22 portions with the apertures 30 on the back side 20 will divert, and therefore, slow air flow through the brush head 12 when applied to the back side by a hair dryer. Indeed, slowed air flow may cause backwash of the air stream reducing the volume of air that can move through the brush head 12. Therefore, at least partial alignment of the apertures 30, 40 will improve drying ability. Entire alignment of the apertures 30, 40 will maximize air flow through the brush head 12. This principle may be equally applicable whether air flow is from the front of the brush to the back or vice versa.

A further method may be realized when considering the longitudinal apertures 30 as a single air inlet (the combined aperture area of each aperture on the back side 20) and the apertures 40 as a single air outlet (the combined aperture area of each aperture on the front side 22). Having a larger air inlet compared to an air outlet will focus an air stream applied to the back side 20 of the brush head 12 through the smaller area of the outlet for a more controlled drying experience. Conversely, when considering the longitudinal apertures 30 as a single air outlet and the apertures 40 as a single air inlet, having a larger air outlet functions to minimize constriction of the air flow from front to back to improve drying ability.

Hair brushes 10 disclosed herein may be made of any suitable material or combinations of materials. Examples of contemplated materials include polymers, plastics, metals, rubber, silicone, laminated materials, recycled materials, natural and/or eco-friendly materials, biodegradable materials, and combinations thereof. In one embodiment, a contemplated hair brush 10 may incorporate a light-weight, eco-friendly bamboo handle 14, and a plastic brush head 12 with a flexible plastic or rubber front side 22 into which plastic bristles 44 or bristle clusters 48 are affixed.

In another embodiment, the hair brushes 10 disclosed herein may vary in size, for example, the hair brushes may be sized for an adult or for a child. In one embodiment, a child's hair brush 10 may be approximately about ¾ scale, or about ½ scale, or about ¼ scale of an adult-sized brush. "Adult-sized" brushes 10 may be about 15 to about 25 centimeters in overall length.

EXAMPLE

The hair brushes of the present disclosure were tested relative to other commercially available hair brushes to compare drying speeds as described below.

Materials and Methods

Tresses of virgin European medium brown hair, eight inches in length were first weighed at a dry weight. Tresses were then wetted for 30 seconds with warm tap water (37° C.). The wetted tresses were briefly combed to detangle the tresses and reweighed. The tresses were then dried with a commercial drier on a low setting and positioned 30 centimeters from the tresses. Air temperature at the position of the tresses was monitored to ensure constant drying heat (±5° C.) from one test to the next.

Each experiment was timed, and the time was recorded when the tresses attained a mass that was +20% of original (dry) mass. Five replicates were run for each sample. During drying, the test brush was run down the tresses while being applied from the opposite side of the incoming hot air. The tresses were constantly stroked during drying. Drying of the tresses was recorded during the process every 15 seconds, and the test was concluded when the tresses were touch dry, which corresponds to a residual water content of +20-25% of dry weight of the tresses. At this point, a consumer would typically stop the drying to proceed to styling.

Results

Weight loss of tresses during the drying process using either a sample brush or control brush was calculated as follows: average over the five tresses of $(W_i-W_t)/(W_i-D_i)$, where $W_i$ is the wetted initial weight, $W_t$ is the weight at the specific time, and $D_i$ is the dry initial weight. Statistical analysis of the results showed the differences in drying times to be significant to a probability of error of less than 10%.

Table No. 1 below indicates the drying time of the tresses in seconds for each brush.

TABLE NO. 1

| Drying time. | | |
|---|---|---|
| Test Brush | % faster drying time | Control |
| Paddle | 23% | Conair Velvet Touch |
| Oval | 33% | Conair Ceramic Wood |
| Half-round | 16% | Olivia Garden XL Pro |
| Average | 24% | |

As can be seen from Table No. 1, the paddle, oval, and half-round hair brushes of the present disclosure dried the tresses at least 16% and on average 24% faster than controls.

INDUSTRIAL APPLICABILITY

The hair brushes described herein advantageously improve hair drying.

Numerous modifications will be apparent to those skilled in the art in view of the foregoing description. Accordingly, this description is to be construed as illustrative only and is presented for the purpose of enabling those skilled in the art to make and use the invention and to teach the best mode of carrying out same. The exclusive rights to all modifications which come within the scope of the application are reserved. All patents and publications are incorporated by reference.

I claim:

1. A hair brush, comprising:

a brush head comprising opposing front and back sides having a hollow portion therebetween, wherein the back side includes a plurality of longitudinal apertures that extend between first and second ends of the brush head, at least one of the longitudinal apertures having a length L and extending substantially the entire length of the brush head, wherein the front side includes first and second sets of apertures separated by a medial portion, wherein at least one of the apertures of the first and second sets of apertures is elongate and parallel to at least one of the longitudinal apertures, and wherein at least one of the apertures of the first and second sets of apertures has a length dimension of at least about 0.3 L to about 0.6 L.

2. The hair brush of claim 1 further comprising a handle from which the brush head extends.

3. The hair brush of claim 2, wherein the handle is comprised of a natural material.

4. The hair brush of claim 3, wherein the natural material comprises bamboo.

5. The hair brush of claim 1, wherein the length L ranges from about 4 to about 12 centimeters.

6. The hair brush of claim 5, wherein the length L ranges from about 4 to about 8 centimeters.

7. The hair brush of claim 1, wherein the at least one of the apertures of the first and second sets of apertures has a length dimension of about 0.4 L.

8. The hair brush of claim 1, wherein the front side comprises a plurality of bristles.

9. The hair brush of claim 8, wherein the bristles comprise at least one of a post-type bristle or a cluster bristle.

10. The hair brush of claim 8, wherein the bristles are arranged in longitudinal rows spaced apart by a width W.

11. The hair brush of claim 10, wherein at least one of the apertures of the first and second sets of apertures has a width dimension of at least 0.8 W.

12. The hair brush of claim 1, wherein the front side comprises a flexible insert.

13. The hair brush of claim 1, wherein at least one aperture from the first set of apertures is longitudinally aligned with at least one aperture from the second set of apertures to form a longitudinal aperture pair.

14. The hair brush of claim 13, wherein the front side comprises a plurality of longitudinal aperture pairs.

15. The hair brush of claim 14, wherein at least one aperture pair is partially aligned with at least one of the longitudinal apertures in the back side.

16. The hair brush of claim 14, wherein at least one aperture pair is entirely aligned with at least one of the longitudinal apertures in the back side.

17. A hair brush, comprising:

a handle;

a head that extends from the handle, the head comprising a front side having a face, a back side, and an internal volume extending between the front side and the back side;

a plurality of longitudinal inlets disposed on the back side defining an inlet area; and a plurality of first and second outlets separated by a medial portion disposed in the face defining an outlet area, wherein at least one of the plurality of longitudinal inlets extends substantially the entire length of the head, wherein at least one outlet of the plurality of first and second outlets is elongate and parallel to at least one of the longitudinal inlets, and wherein a ratio of the inlet area to the outlet area is at least about 1:1.

18. The hair brush of claim 17, wherein the ratio of the inlet area to the outlet area is at least about 3:2.

19. A hair brush, comprising:

a brush head comprising opposing front and back sides having a hollow portion therebetween, wherein the back side includes a plurality of longitudinal apertures that extend between first and second ends of the brush head, at least one of the longitudinal apertures extending substantially the entire length of the brush head, wherein the front side includes first and second sets of apertures separated by a medial portion, wherein at least one of the apertures of the first and second sets of apertures is elongate and parallel to at least one of the longitudinal apertures, and wherein at least one of the plurality of longitudinal apertures extends over an area that is coextensive with the medial portion.

20. The hair brush of claim 19, wherein the medial portion is orthogonal to a handle that extends from the brush head.

* * * * *